United States Patent [19]

Kellerstrass

[11] 4,165,073

[45] Aug. 21, 1979

[54] WATER GUN GAME WITH REVOLVABLE TARGET MOVABLE ALONG A LINE

[76] Inventor: Donald L. Kellerstrass, 303 Daniel Pkwy., Washington, Ill. 61571

[21] Appl. No.: 887,019

[22] Filed: Mar. 16, 1978

[51] Int. Cl.[2] ..... A63B 63/06; A63H 23/00

[52] U.S. Cl. ..... 273/101; 273/102.1 E; 273/95 AA

[58] Field of Search ..... 273/95 AA, 101, 102.1 E, 273/119 B; 272/1 B; 46/91, 53

[56] References Cited

U.S. PATENT DOCUMENTS

| | | | |
|---|---|---|---|
| 2,285,292 | 6/1942 | Mangels | 273/101 |
| 3,086,775 | 4/1963 | Albert | 273/95 AA |
| 3,190,032 | 6/1965 | Green et al. | 46/53 |
| 3,477,723 | 11/1969 | Djedda | 273/101 |
| 3,843,127 | 10/1974 | Lack | 273/105.2 |

FOREIGN PATENT DOCUMENTS

| | | | |
|---|---|---|---|
| 375673 | 7/1907 | France | 273/95 AA |
| 8000 | 5/1916 | United Kingdom | 273/101 |

*Primary Examiner*—Richard C. Pinkham
*Assistant Examiner*—Lawrence E. Anderson
*Attorney, Agent, or Firm*—Howard I. Podell

[57] ABSTRACT

A game comprising an above the ground line stretched between two upright supports, a target member including a pulley wheel suspended from the line and gun-type hose attachments connected to a source of pressurized water. The object of the game is for each player, using the water gun, to move the target member to the opposite end of the line.

3 Claims, 4 Drawing Figures

WATER GUN GAME WITH REVOLVABLE TARGET MOVABLE ALONG A LINE

FIELD OF THE INVENTION

This invention relates generally to a game playable by two adults or children using water guns to move a novel target.

DESCRIPTION OF THE PRIOR ART

The prior art, as exemplified by U.S. Pat. Nos. 2,759,731; 3,342,492; 3,362,713; 1,525,341 and 2,285,292 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual skill and/or dexterity to operate. As a result of the shortcomings of the prior art, typified by the above, there has developed a substantial need for improvement in this field.

The principal object of this invention is to provide a game of this character which combines simplicity and entertainment in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a game comprising an above the ground line stretched between two upright supports, a target member including a pulley wheel suspended from the line and gun-type hose attachments connected to a source of pressurized water. The object of the game is for each player, using the water gun, to move the target member to the opposite end of the line.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
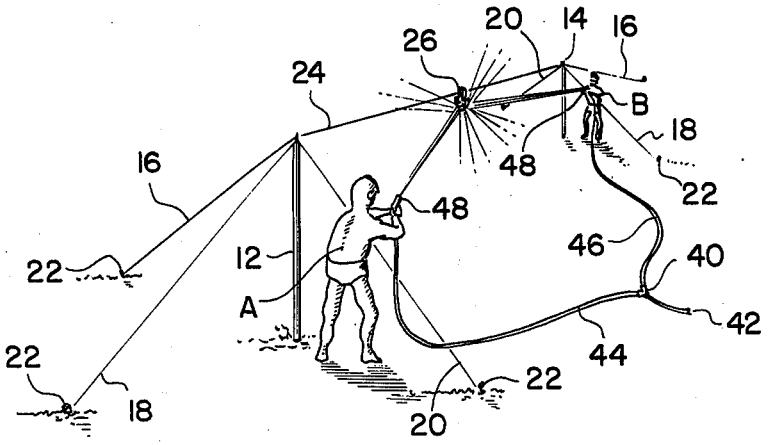
FIG. 1 is an isometric view showing the game as it is played.

With reference to the drawing, there is shown and illustrated water gun game apparatus constructed in accordance with the principles of the invention and designated generally by reference character 10. The illustrated tangible embodiment of the invention includes a pair of spaced apart uprights 12 and 14. Each having a pointed lower end for securing it into the ground. A plurality of guide wires 16, 18, 20 have their upper ends secured to the top of the uprights with their lower ends tied to pegs 22 driven into the ground as is the case with tents. If desired, and to facilitate storage when not in use, the uprights can be telescopic.

A line, a cable or rope 24 is stretched between the tops of uprights 12 and 14. Suitably, the tops have eye bolts or securing rings thereon to secure the ends of the line thereto.

Figure 2:
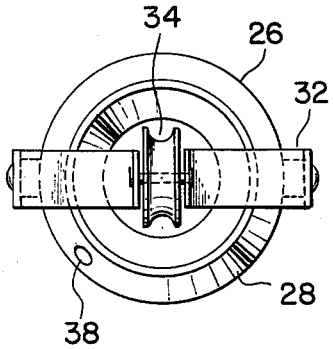
FIG. 2 is a top plan view of the novel target member therefore.
Figure 3:
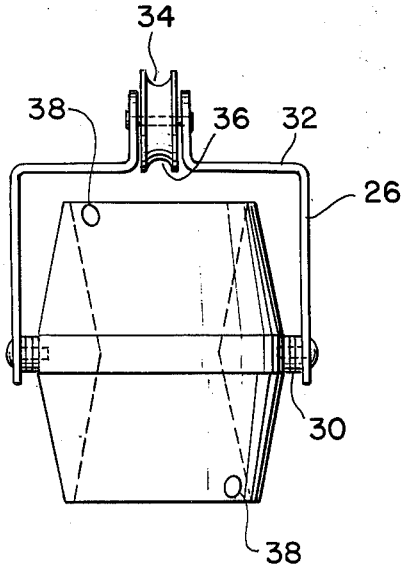
FIG. 3 is a front elevation of same.
Figure 4:
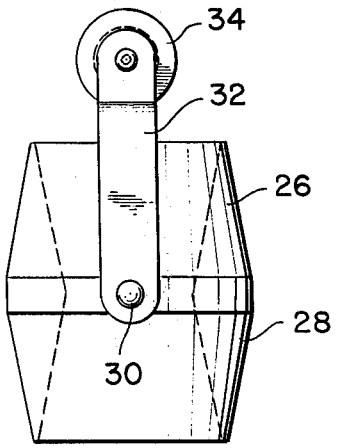
FIG. 4 is a side elevation thereof.

FIGS. 2, 3 and 4 show the novel target member 26 for the game of the invention. This member includes a mini-barrel 28 made of metal or plastic secured rotatably by pin 30 between the ends of bracket 32. The upper ends of the two bracket members have pulley wheel 34 rotatably mounted between them. Pulley wheel 34 has a concave periphery 36 which enables it to ride smoothly upon line 24. Barrel 28 has a pair of spaced holes 38 to allow water to enter and leave therefrom so as to complicate the game as does the rotation of barrel 28 on its axis.

A garden hose "Y" connection 40 is mounted on a hose bib 42 connected to an outlet. A pair of hoses 44, 46 have one end attached to the ends of the connection 40 and have on their other ends a pistol-grip type spray nozzle 48.

The object of the game, as will be apparent from FIG. 1 is for a player (A or B) to accurately direct a spray of water from his gun onto target 26 so as to bring same to the opposite end of rope 24. The goal may be the opposite upright or some other point on line 24 which will be designated by a mark or a signal such as a bell or other indicating means.

The actual length of line 24 will, of course, be dependent on the space available in the garden, yard or beach.

The game can come with ausiliary accessories such as firemen's hats, raincoats and the like. It is primarily a summertime game which not only amuses the participants but also can cool them off when desired.

The operation and use of the invention hereinabove described will be evident to those skilled in the art to which it relates from a consideration of the foregoing.

The present invention is believed to accomplish among others all of the objects and advantages herein set forth.

Without further analysis, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. Water gun game apparatus, comprising, in combination, a pair of spaced apart vertical uprights; a line extending between said uprights above the ground; a target including a bracket having a pulley wheel suspended from said line in the upper part thereof and a hollow member revolvably mounted in the lower part thereof and a plurality of water guns associated with each player playing the game for directing a jet of water upon said target so as to move same toward the end opposite one of said players.

2. The invention as recited in claim 1, wherein said hollow member includes an opening in the top and in the bottom thereof.

3. The invention as recited in claim 1, further including a three-way connection to a source of water; a pair of hoses attached to said connection at one end thereof and pistol-grip type spray nozzles mounted on the other ends thereof.

* * * * *